US006966855B2

(12) United States Patent
Yu

(10) Patent No.: US 6,966,855 B2
(45) Date of Patent: Nov. 22, 2005

(54) RACKET WITH CAPABILITY OF VIBRATION ABSORPTION

(76) Inventor: Kuo-Pin Yu, No. 6, Lane 477, Sec. 2, Feng Shih Road, Feng Yuan, Taichung (TW)

( * ) Notice: Subject to any disclaimer, the term of this patent is extended or adjusted under 35 U.S.C. 154(b) by 0 days.

(21) Appl. No.: 10/623,773

(22) Filed: Jul. 22, 2003

(65) Prior Publication Data

US 2005/0003911 A1 Jan. 6, 2005

(51) Int. Cl.[7] ..... A63B 49/02
(52) U.S. Cl. ..... 473/521
(58) Field of Search ..... 473/520, 521, 473/524

(56) References Cited

U.S. PATENT DOCUMENTS 4,875,679 A 10/1989 Movilliat et al.
4,983,242 A * 1/1991 Reed ..... 156/172
5,131,651 A * 7/1992 You ..... 473/520
5,135,223 A * 8/1992 You ..... 473/523
5,174,568 A * 12/1992 You ..... 473/521
5,286,022 A * 2/1994 You ..... 473/521
5,314,180 A * 5/1994 Yamagishi et al. ..... 473/521
5,409,215 A 4/1995 You
6,319,159 B1 * 11/2001 Yu ..... 473/535
6,537,164 B1 * 3/2003 Hsu ..... 473/521
6,592,475 B2 * 7/2003 Poggi et al. ..... 473/524

FOREIGN PATENT DOCUMENTS

FR 2684560 6/1993

* cited by examiner

*Primary Examiner*—Raleigh W. Chiu
(74) *Attorney, Agent, or Firm*—Bacon & Thomas

(57) ABSTRACT

A racket includes a frame having a rim and a connection portion at an end of the rim, a handle fixed at a distal end of the connection portion, an elastic member attached on a predetermined portion of the frame, and a cover layer wrapped around the frame and the elastic member. The vibration wave transmission velocities of the frame, the elastic member and the cover layer are different from one another and the vibration is therefore reduced while transmitting therethrough.

9 Claims, 5 Drawing Sheets

RACKET WITH CAPABILITY OF VIBRATION ABSORPTION

BACKGROUND OF THE INVENTION

1. Field of the Invention

The present invention relates generally to a sport good, and more particularly to a racket with a superior capability of vibration absorption.

2. Description of the Related Art

Conventional rackets with several apparatuses for vibration absorption, such as a racket frame is mounted with an elastic tube. The vibration absorption is completed by the change of the speeds of the vibration waves transmitting through the frame and the elastic tube so that the vibration absorption capability works only in the condition of the vibration waves transmitting to the frame rather than the network. Such racket has a fine capability of vibration absorption but it still has better ways for improvement.

SUMMARY OF THE INVENTION

The primary objective of the present invention is to provide a racket having a superior capability of vibration absorption.

The secondary objective of the present invention is to provide a racket having the capability of vibration absorption both at the frame and the network.

According to the objectives of the present invention, a racket comprises a frame having a rim and a connection portion at an end of the rim, a handle coupled with a distal end of the connection portion, an elastic member mounted on a predetermined portion of the frame, and a cover layer wrapped around the frame and the elastic member.

The vibration wave transmission velocities of the frame, the elastic member and the cover layer are different from one another and the vibration is therefore reduced while transmitting therethrough.

DETAILED DESCRIPTION OF THE INVENTION

Figure 1:
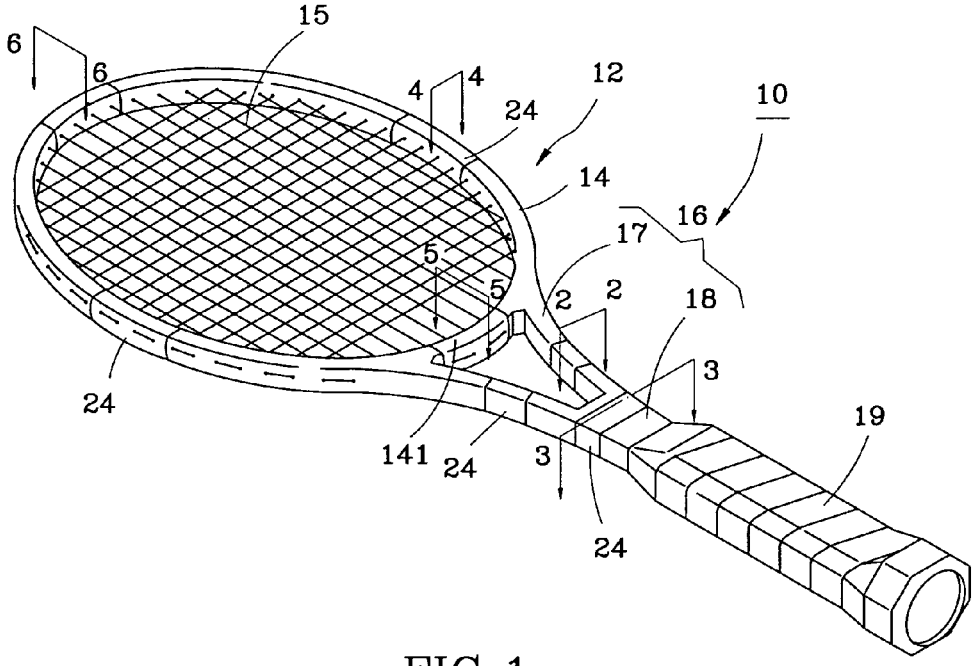
FIG. 1 is a perspective view of a first preferred embodiment of the present invention.

A tennis racket 10 of the first preferred embodiment of the present invention is shown in FIG. 1, which has a frame 12 and a handle 19. Elastic members 20 are mounted on several portions of the frame 12 respectively and cover layers 24 wrapped around each the elastic member 20 and the frame 12. A pad 28 might be provided between the elastic member 20 and the cover layer 24.

The frame 12 is composed of an elliptical rim 14 and a Y-shaped connection portion 16. A network 15 is mounted on the rim 14. The connection portion 16 has two arms 17 and a shaft 18, wherein the arms 17 respectively have one end coupled with the rim 14, and the other ends of the arms 17 are merged together and coupled with an end of the shaft 18, and the other end of the shaft 18 is coupled with the handle 19.

The elastic members 20 are attached on the frame 12 and the cover layers 24 are made into tubes and are wrapped around each elastic member 20 and the frame 12. The frame 12, the elastic members 20 and the cover layers 24 have different vibration wave transmission velocities from one another. The elastic members 20 and the cover layers 24 have different shapes and positions to be mounted and that will be described hereunder.

Figure 2:
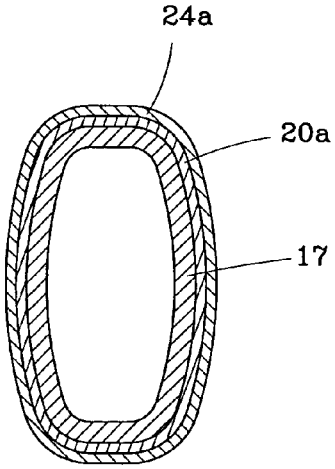
FIG. 2 is a sectional view along 2—2 line of FIG. 1.

As shown in FIG. 2, the elastic member 20*a* is made into a tube to be mounted on the arm 17 and the cover layer 24*a* is wrapped around the elastic member 20*a*.

Figure 3:
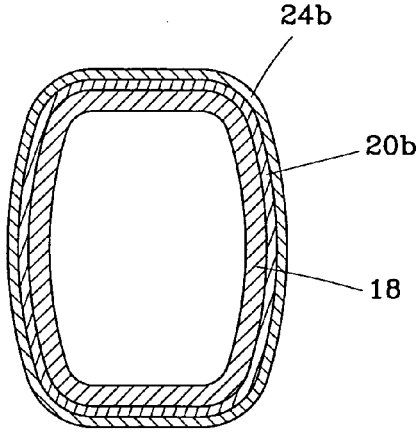
FIG. 3 is a sectional view along 3—3 line of FIG. 1.

As shown in FIG. 3, the elastic member 20*b* is made into a tube to be mounted on the shaft 18 and the cover layer 24*b* is wrapped around the elastic member 20*b*.

Figure 4:
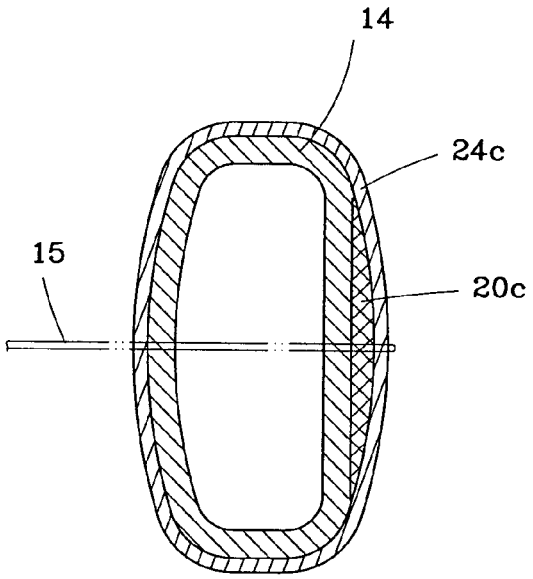
FIG. 4 is a sectional view along 4—4 line of FIG. 1.

As shown in FIG. 4, the elastic member 20*c* is made into a piece to be firmly attached on the rim 14 of the frame 12 and the cover layer 24*c* is wrapped around the elastic member 20*c* and the rim 14. The elastic member 20*c* has a better elasticity and a lower vibration wave transmission velocity than the cover layer 24*c*. The network 15 is threaded through the rim 14, the elastic member 20*c* and the cover layer 24*c*, and then is wound around the cover layer 24*c*.

Figure 5:
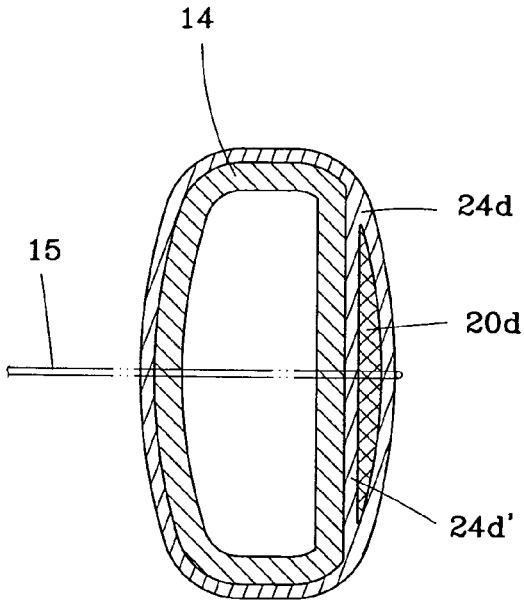
FIG. 5 is a sectional view along 5—5 line of FIG. 1.

It is preferred that the elastic member 20*d* is attached on the rim 14 between the arms 17 (this position is called "crescent portion" 141 of the rim 14). As shown in FIG. 5, the cover layer 24*d* is wrapped around the elastic member 20*d* and the rim 14. The cover layer 24*d* further has an interlayer 24*d*' between the rim 14 and the elastic member 20*d* to keep them away from each other. The network 15 is threaded through the rim 14, the interlayer 24*d*', the elastic member 20*d* and the cover layer 24*d*, and then is wound around the cover layer 24*d*. The advantage of elastic member 20*d* and the cover layer 24*d* mounted on the crescent portion 141 of the rim 14 is that they provide the capability of vibration absorption but does not affect the swing weight of the racket 10.

Figure 6:
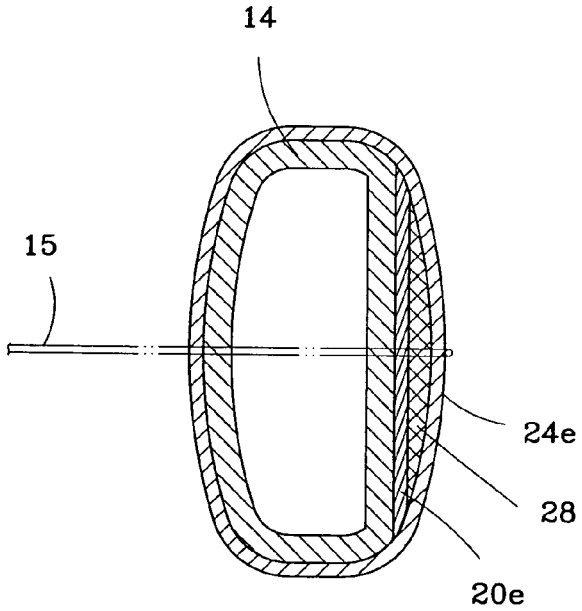
FIG. 6 is a sectional view along 6—6 line of FIG. 1.

As shown in FIG. 6, the elastic member 20*e* is attached on the rim 14. The cover layer 24*e* is wrapped around the elastic member 20*e* and the rim 14. A pad 28 is mounted between the elastic member 20*e* and the cover layer 24*e*. The vibration wave transmission velocities of the pad 28, the rim 14 (or the frame 12), the elastic member 20*e* and the cover layer 24*e* are different from one another. In the present invention, the pad 28 has a hardness greater than the elastic member 20*e* and cover layer 24*e*, so that the pad has a lower elasticity and greater vibration wave transmission velocity. The network 15 has a same way mounted thereon as the other, so the detail is not described again.

The elastic members 20, the pad 28 and the cover layers 24, as shown in FIG. 4 to FIG. 6, take the tension of the network 15 directly so that vibration waves transmitting from the network 15 to the rim 14 will be absorbed and reduced by the elastic members 20, the pad 28 and the cover layers 24 on the rim 14. As unabsorbed vibration waves transmit from the rim 14, via the arms 17 to the shaft 18, and they are absorbed by the elastic members 20 and the cover layers 24 on the arms 17 and the shaft 18 as shown in FIG. 2 and FIG. 3, such that there is less vibration transmitting to the handle 19.

It has to be mentioned that the present invention provides the elastic members 20, the cover layers 24 and the pad 28 with different elasticity that make vibration waves having different velocities for transmission therein. The vibration amplitudes and frequencies of the elastic members 20, the cover layers 24 and the pad 28 are all different from the frame 12 and the vibrations therein are offset by one another to reduce the vibration waves. In other words, the amplitude of vibration will be reduced because the vibration waves transmit through different intermediums (the frame 12, the elastic members 20, the cover layers 24 and the pad 28) and there is less vibration transmitting to the handle 19. On the other hand, there are elastic members 20 and the cover layers 24 mounted on the rim 14 contacting the network 15 directly that absorb the vibration directly from the network 15 so that there is less vibration transmitting to the rim 14.

In fabrication, the elastic members 20, the cover layers 24 and the pad 28 are made of rubber or plastics, such as thermoplastic rubber (TPR), polyurethane (PU), polystyrene (PS) or fiber composite materials (such as carbon composite material). In fact, the materials are not the main scope of the present invention, but the elastic members 20, the cover layers 24 and the pad 28 should have different elasticity and vibration wave transmission velocity from one another and the elasticity should be alternated to achieve the capability of vibration absorption.

Figure 7:
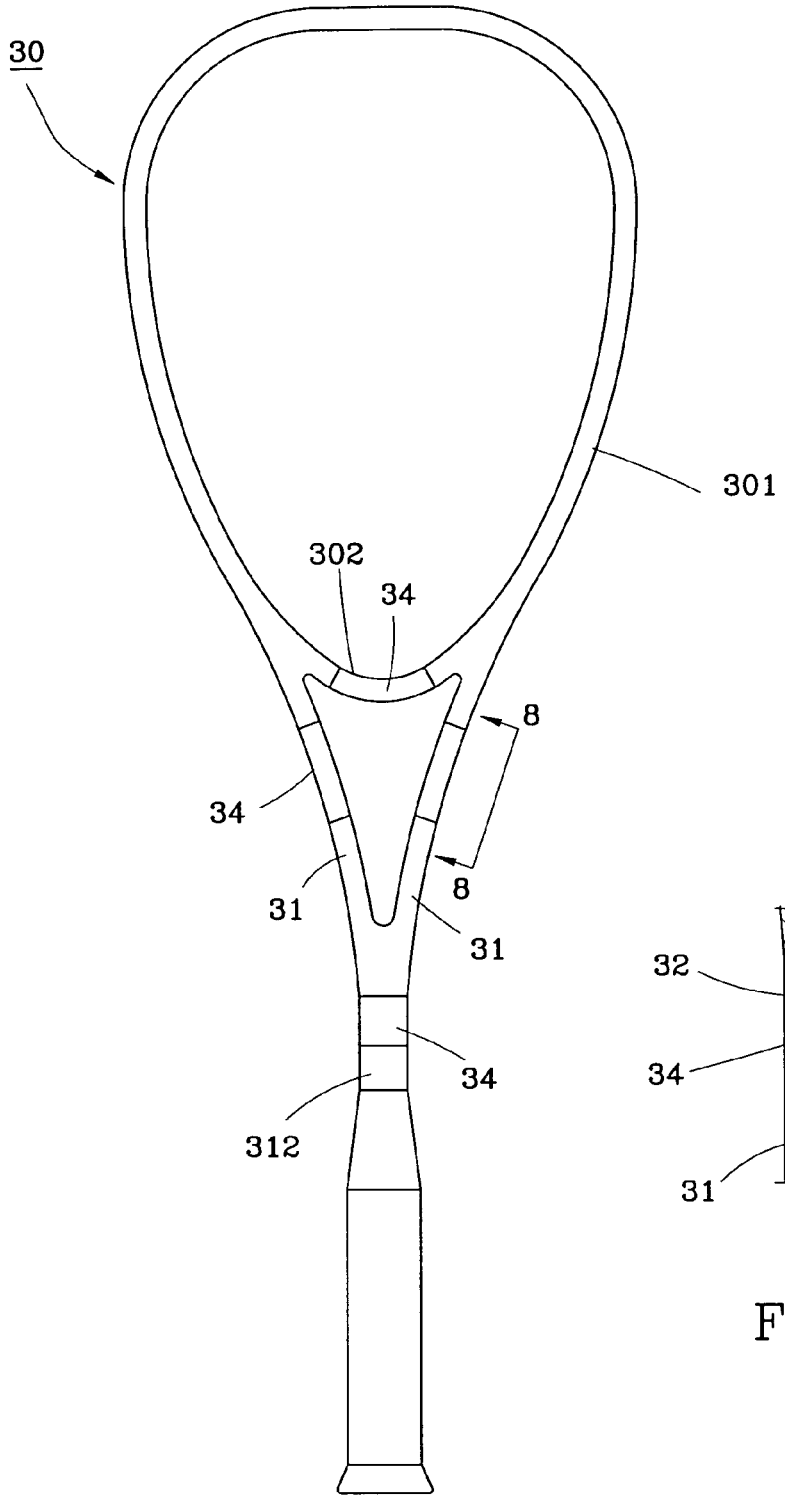
FIG. 7 is a front view in a part of a second preferred embodiment of the present invention.
Figure 8:
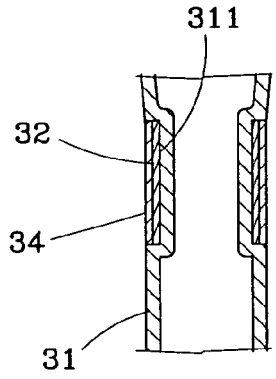
FIG. 8 is a sectional view along 8—8 line of FIG. 7.

As shown in FIG. 7, the second preferred embodiment of the present invention provides a squash racket 30 having a rim 301, two arms 31, a shaft 312 and a handle. Elastic members 32 and cover layers 34 are mounted on many portions, such as a crescent portion 302 of the rim 301, the arms 31 or the shaft 312. As shown in FIG. 8, the arm 31 is provided with an annular recess 311 in which the elastic member 32 and the cover layer 34 are mounted. Except for the elastic member 32 and the cover layer 34, the arm 31 at where the recess 311 is can absorb a part of vibration while vibration waves transmit therethrough.

Figure 9:
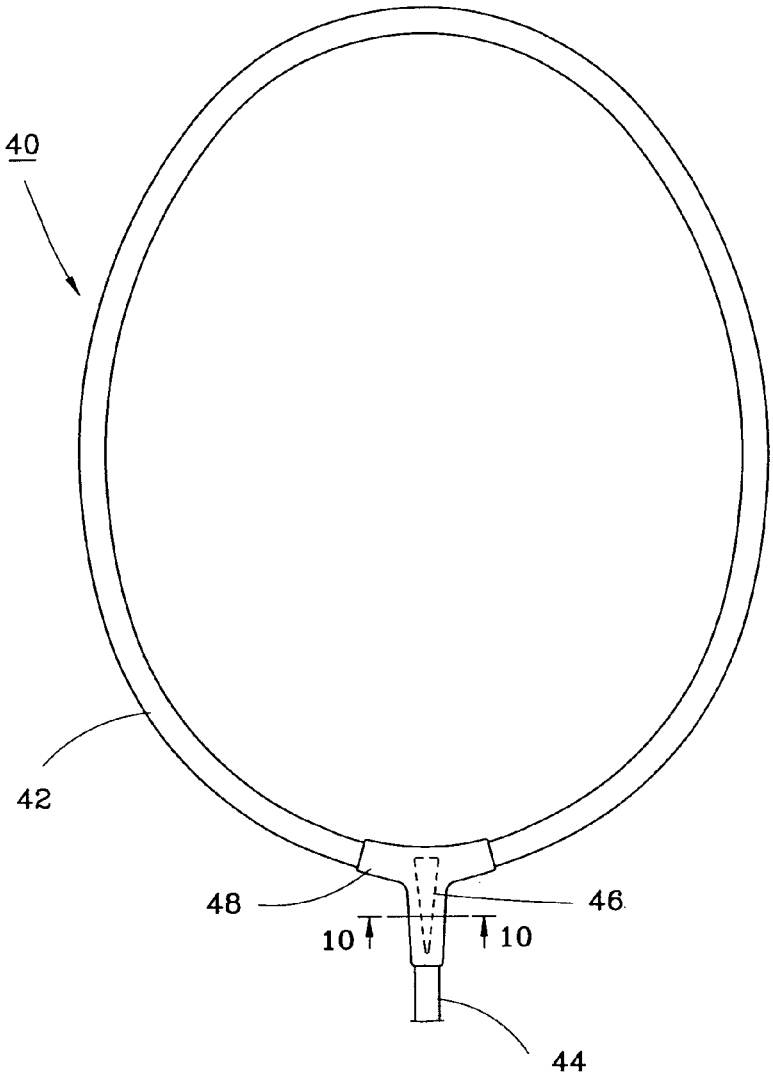
FIG. 9 is a front view in a part of a third preferred embodiment of the present invention.
Figure 10:
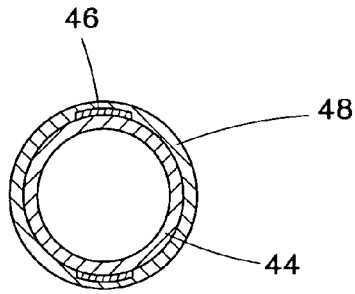
FIG. 10 is a sectional view along 10—10 line of FIG. 9.

As shown in FIG. 9 and FIG. 10, the third preferred embodiment of the present invention provides a badminton racket 40 having a rim 42 and a connection portion 44. The connection portion 44 is a shaft with an end thereof coupled with the rim 42 and the other end thereof coupled with a handle. Two elastic members 46 are attached on opposite sides of a junction of the rim 42 and the connection portion 44 and a cover layer 48 is wrapped thereon.

Figure 11:
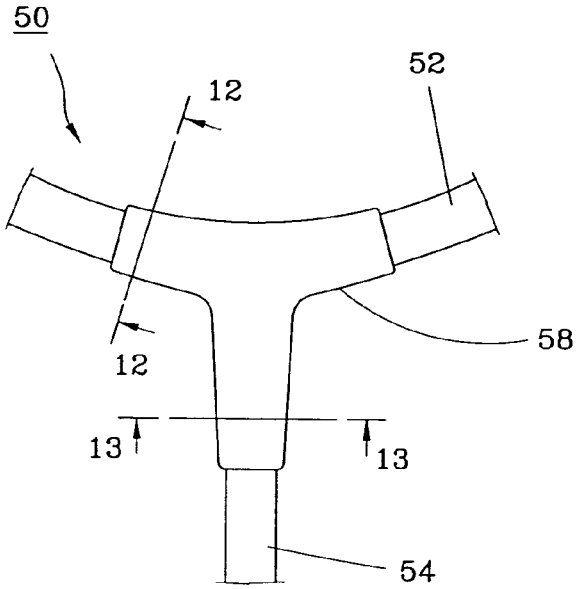
FIG. 11 is a front view in a part of a fourth preferred embodiment of the present invention.
Figure 12:
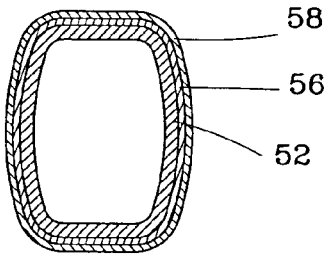
FIG. 12 is a sectional view along 12—12 line of FIG. 11.
Figure 13:
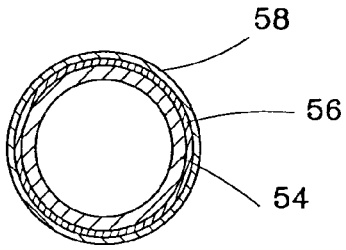
FIG. 13 is a sectional view along 13—13 line of FIG. 11.

FIG. 11, FIG. 12 and FIG. 13 show a badminton racket 50 of the fourth preferred embodiment of the present invention. An elastic member 56 and a cover layer 58 are wrapped on a junction of a rim 52 and a connection portion 54 of the racket 50 in sequence.

The elastic members 46 and 56 and the cover layers 48 and 58 absorb most of the vibration from the rim 52 to the connection portion 54.

The main scope of the present invention is mounting the elastic members and the cover layers on many portions of a racket. The racket might be tennis racket, badminton racket and the like.

What is claimed is:

1. A racket, comprising:

a frame having a rim and a connection portion at an end of the rim;

a handle fixed at a distal end of the connection portion;

an elastic member attached on a predetermined portion of the frame;

a cover layer wrapped around the frame and the elastic member; and a pad arranged between the elastic member and the cover layer;

wherein the vibration wave transmission velocities of the pad, the frame, the elastic member and the cover layer are different from one another.

2. The racket as defined in claim 1, wherein the elastic member is formed as a tube.

3. The racket as defined in claim 1, wherein the elastic member is made into a piece.

4. The racket as defined in claim 1, wherein the cover layer has an interlayer between the elastic member and the frame.

5. The racket as defined in claim 1, wherein the connection portion has two arms and a shaft, wherein the arms respectively have one end coupled with the rim, and the other ends of the arms are merged together and coupled with an end of the shaft, and the other end of the shaft is coupled with the handle.

6. The racket as defined in claim 5, wherein the elastic member is mounted on the rim and located between the arms.

7. The racket as defined in claim 5, wherein the elastic member is mounted on one of the arms.

8. The racket as defined in claim 5, wherein the elastic member is mounted on the shaft.

9. The racket as defined in claim 1, wherein the elastic member is mounted on the rim.

* * * * *